US006347663B1

(12) United States Patent
Hunzinger et al.

(10) Patent No.: US 6,347,663 B1
(45) Date of Patent: Feb. 19, 2002

(54) FITTING/MANIFOLD ASSEMBLY AND METHOD FOR A HEAT EXCHANGER

(75) Inventors: Thomas A. Hunzinger; Ken Nakayama, both of Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/524,115

(22) Filed: Mar. 13, 2000

(51) Int. Cl.[7] ..... F28F 9/04; F16L 41/08

(52) U.S. Cl. ..... 165/178; 285/382.4; 285/189; 228/136; 228/189

(58) Field of Search ..... 165/76, 173, 178; 285/141.1, 189, 382.4; 228/136, 183

(56) References Cited

U.S. PATENT DOCUMENTS

| | | | | | |
|---|---|---|---|---|---|
| 587,546 | A | * | 8/1897 | Dillenburg | 285/382.4 |
| 1,124,504 | A | * | 1/1915 | Mueller | 285/382.4 |
| 2,269,895 | A | * | 1/1942 | Foster et al. | 285/382.4 |
| 2,566,502 | A | * | 9/1951 | Smith | 285/382.4 |
| 2,779,998 | A | | 2/1957 | Bailey | |
| 3,289,287 | A | | 12/1966 | Guritz | |
| 4,465,129 | A | | 8/1984 | Baldensperger et al. | |
| 4,528,733 | A | | 7/1985 | Lord | |
| 4,887,849 | A | | 12/1989 | Briet | |
| 4,887,853 | A | * | 12/1989 | Flowers et al. | 285/287 |
| 5,048,602 | A | | 9/1991 | Motohashi et al. | 165/173 |
| 5,151,157 | A | * | 9/1992 | le Gauyer | 165/140 |
| 5,564,756 | A | | 10/1996 | Hamilton | |
| 5,758,904 | A | * | 6/1998 | Ross et al. | 285/23 |
| 5,785,119 | A | | 7/1998 | Watanabe et al. | |

FOREIGN PATENT DOCUMENTS

| | | |
|---|---|---|
| EP | 0745824 | 4/1996 |
| FR | 2272769 | 12/1975 |
| JP | 03199897 | 8/1991 |
| JP | 3249498 | 11/1991 |

* cited by examiner

*Primary Examiner*—Allen Flanigan
(74) *Attorney, Agent, or Firm*—Wood, Phillips, VanSanten, Clark & Mortimer

(57) ABSTRACT

A fitting/manifold assembly and method are provided for a heat exchanger. The method includes the steps of providing a manifold (22) including a wall (30) having an aperture (32) therethrough; providing a fitting (24) including a body (42), a nipple (44) extending from the body (42) and having an interior surface (50), and an opening (54) extending through the body (42) to allow access to the interior surface (50); inserting the nipple (44) into the aperture (32) from one side of the wall (30) so that the body (42) of the fitting (24) is on the one side of the wall (30) and a portion (48) of the nipple (44) is on the other side of the wall (30); deforming the interior surface (50) of the nipple (44) with a deforming tool (60, 104) inserted through the opening (54) in the body (42) to enlarge the portion (48) to a shape that restricts retraction of the nipple (44) from the aperture (32).

9 Claims, 4 Drawing Sheets

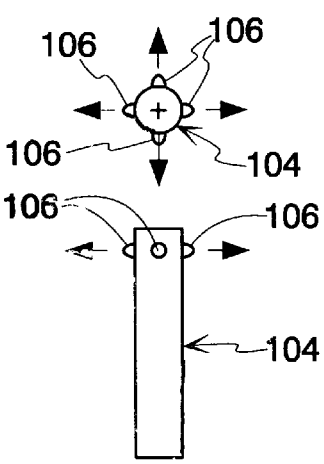
Fig. 15
Fig. 14
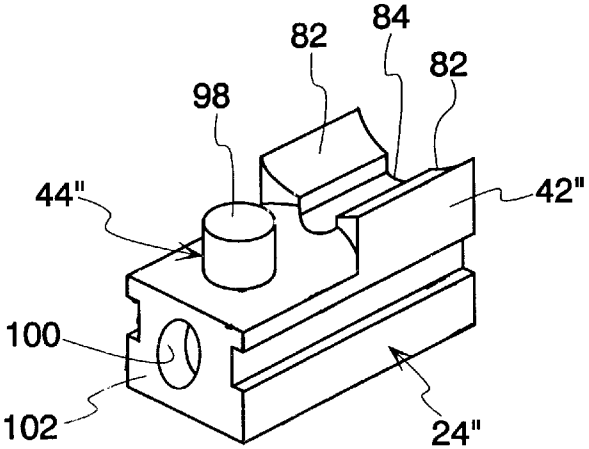
Fig. 12
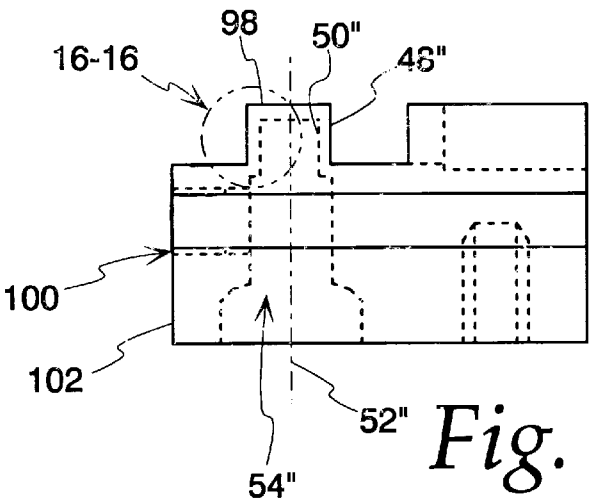
Fig. 13
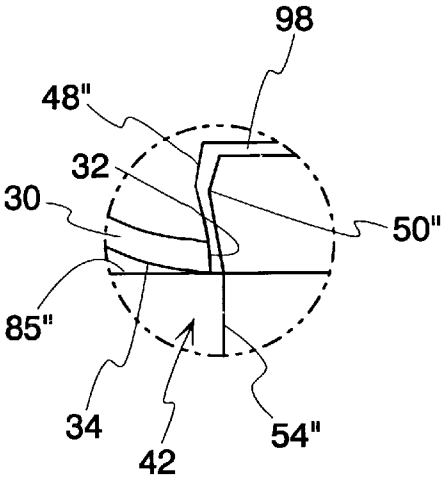
Fig. 16

FITTING/MANIFOLD ASSEMBLY AND METHOD FOR A HEAT EXCHANGER

FIELD OF THE INVENTION

The present invention relates to heat exchangers, and more particularly to a fitting/manifold assembly and method for a heat exchanger.

BACKGROUND OF THE INVENTION

It is known in the heat exchanger art to use a fitting attached to a manifold forming part of the heat exchanger to define either an inlet, an outlet, or a jump tube connector for the manifold. Such fittings are often assembled to a manifold by first positioning the fitting relative to the manifold so that an opening in the fitting is aligned with an opening in the manifold. It is known to align the openings by providing a nipple on either the fitting or the manifold and then inserting the nipple in an opening formed in the component without the nipple. After the openings are aligned, the fitting is skived or tac-welded to the manifold to prevent relative movement therebetween. The fitting/manifold assembly then undergoes a bonding process, such as brazing, to form a sealed joint between the fitting and the manifold. While these methods of assembly may work for their intended purpose, there is always room for improvement.

For example, the set-up for the skiving and/or the tac-welding can be time-consuming, and the tac-weld can alter the material properties of the fitting and/or manifold surrounding the weld.

SUMMARY OF THE INVENTION

It is a principal object of the invention to provide a new and improved fitting/manifold assembly and a method for assembling the same.

According to one aspect of the invention, a method is provided for positioning a fitting relative to a manifold of a heat exchanger. The method includes the steps of providing a manifold including a wall having an aperture therethrough; providing a fitting including a body, a nipple extending from the body and having an interior surface, and an opening extending through the body to allow access to the interior surface; inserting the nipple into the aperture from one side of the wall so that the body of the fitting is on said one side of the wall and a portion of the nipple is on the other side of the wall; deforming the interior surface of the nipple with a deforming tool inserted through said opening in said body to enlarge said portion to a shape that restricts retraction of the nipple from the aperture.

According to one aspect of the invention, the method further includes the step of brazing the fitting to the manifold.

According to another aspect of the invention, the opening has a central axis and the deforming step includes forcing the tool along the axis.

According to yet another aspect of the invention, the interior surface is a nominally frustoconical surface and the deforming step includes deforming the frustoconical surface into a nominally cylindrical surface.

According to one aspect of the invention, a fitting/manifold assembly is provided for a heat exchanger. The assembly includes a manifold and a fitting. The manifold includes a wall having a thickness and a aperture extending through the thickness from an exterior of the manifold to an interior of the manifold. The aperture has a predetermined shape. The fitting includes a body and a deformable nipple extending from the body. The nipple has an exterior surface, an interior surface, and a portion extended from the body a distance greater than the thickness of the wall. The nipple is deformable from a first shape to a second shape. In the first shape the exterior surface of the nipple nominally conforms to the predetermined shape of the aperture to allow the nipple to be freely inserted into the aperture with the portion extending through the wall into the interior of the manifold. In the second shape, the portion is enlarged to retain the nipple in the aperture. The fitting further includes an opening extending through the body to allow access to the interior surface of the nipple by a deforming tool inserted through the opening to deform the nipple from the first shape to the second shape.

Other objects, features and advantages of the invention will be apparent from the following detailed description taken in conjunction with the accompanying drawings, the above summary, and the appended claims.

BRIEF DESCRIPTION OF THE DRAWINGS

FIG. 12 is a perspective view of yet another embodiment of the fitting shown in FIG. 1;

FIG. 13 is a side elevation of the fitting shown in FIG. 12;

FIGS. 14 and 15 are views of a tool used in connection with the fitting shown in FIGS. 12 and 13; and FIG. 16 is an enlarged view of the fitting shown in FIGS. 12 and 13 showing the fitting in a deformed state.

BRIEF DESCRIPTION OF THE PREFERRED EMBODIMENTS

Figure 1:
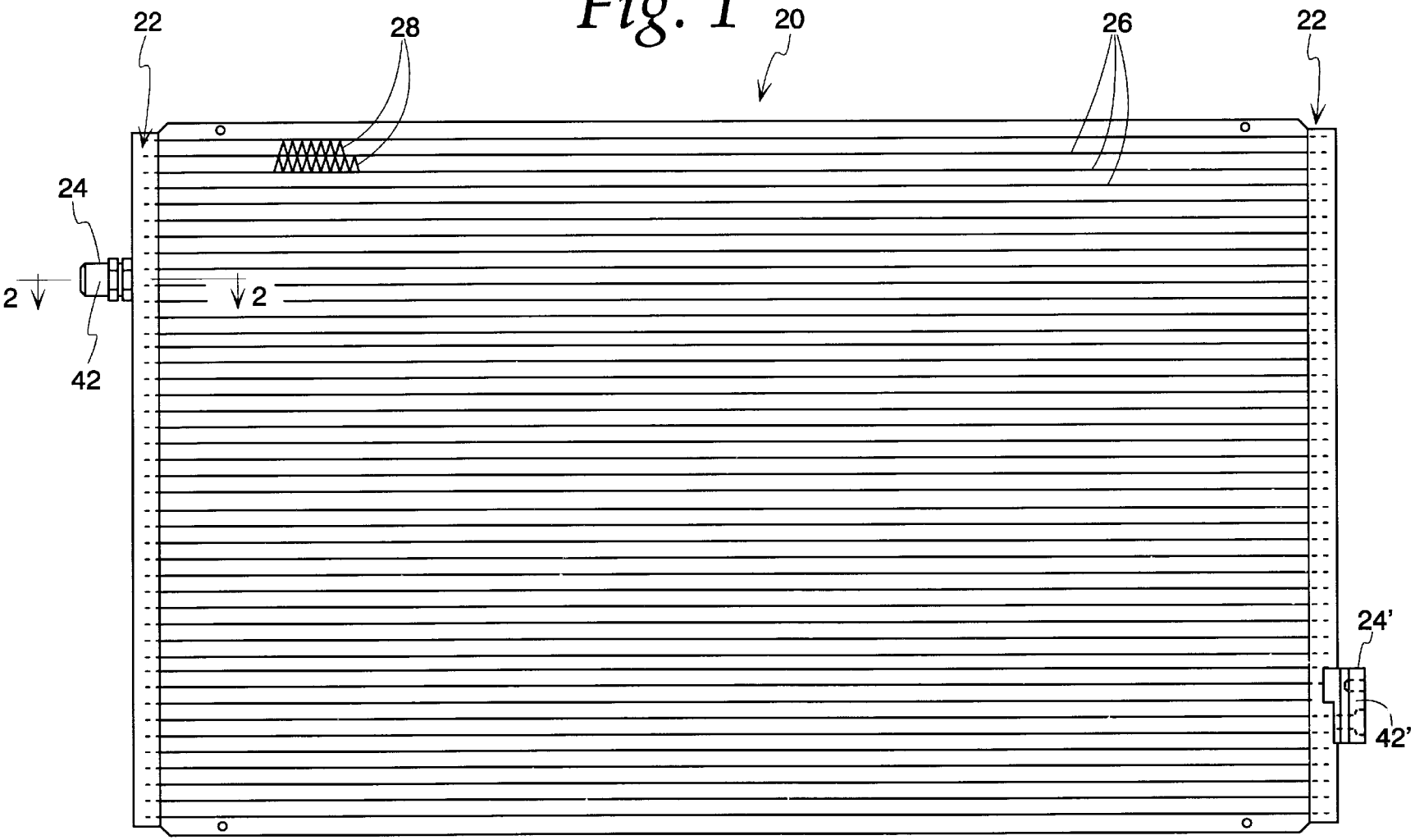
FIG. 1 is a front elevation of a heat exchanger including a fitting/manifold assembly made according to the present invention.

Several exemplary embodiments of a fitting/manifold assembly are illustrated in the drawings in connection with a parallel flow heat exchanger 20 including a pair of elongate manifolds in the form of cylindrical, tubular headers 22; one or more fittings 24 attached to at least one of the headers 22; a plurality of multi-port, flattened tubes 26 extending between the headers 22; and serpentine fins 28 (shown schematically in FIG. 1) extending between adjacent ones of the tubes 24. However, it should be understood that the invention may find utility in other forms of heat exchangers utilizing other types of manifolds, fins, and heat exchanger tubes or conduits, such as for example, cylindrical heat exchange tubes, plate fins, serpentine-type heat exchangers, etc. Moreover, the manifolds need not be cylindrical in cross-section and may be of a multi-piece construction, such as a tank connected to a header. Accordingly, no limitation for use for the specific form of heat exchanger or manifold is intended except insofar as expressly stated in the appended claims.

Figure 2:
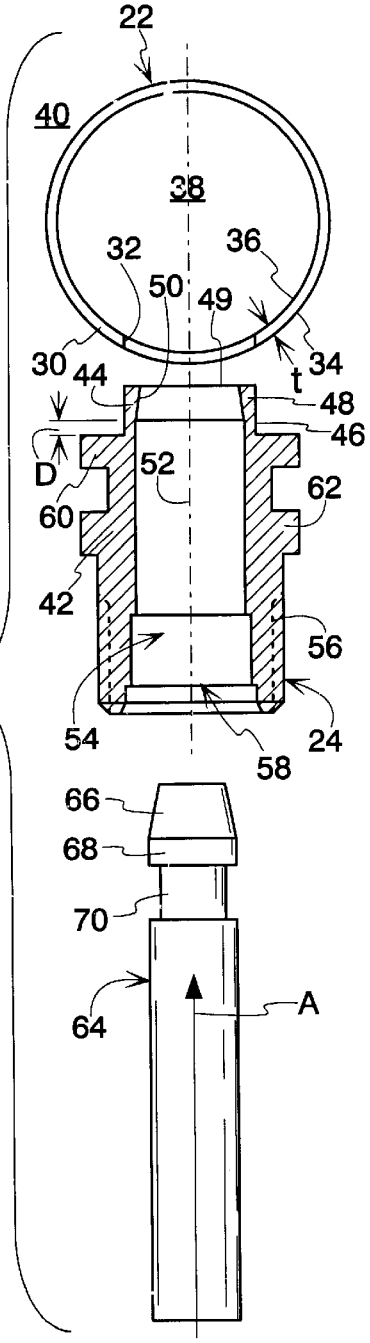
FIG. 2 is an exploded, section view taken along line 2—2 in FIG. 1.
Figure 7:
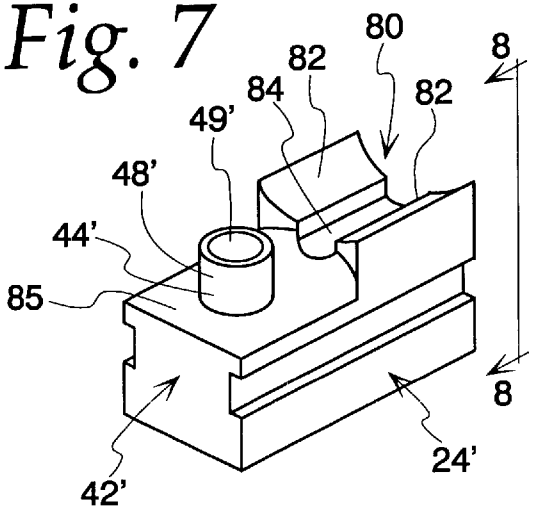
FIG. 7 is a perspective view of another embodiment of the fitting shown in FIG. 1.
Figure 8:
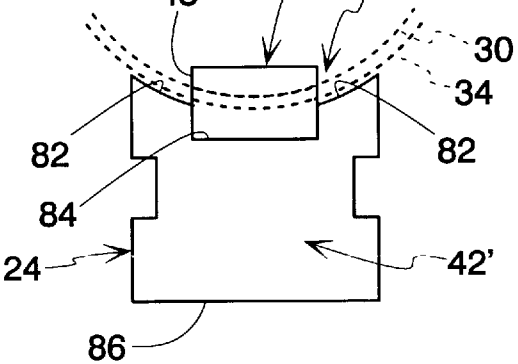
FIG. 8 is a view taken along line 8—8 in FIG. 7.

With reference to FIG. 2, the manifold 22 includes a wall 30 having an aperture 32 in the form of a circular hole extending through the wall from one side 34 of the wall to the other side 36 of the wall 30 over a thicknesst of the wall 30. The wall 30 separates an interior volume 38 in the manifold 22 from the exterior 40.

Figure 3:
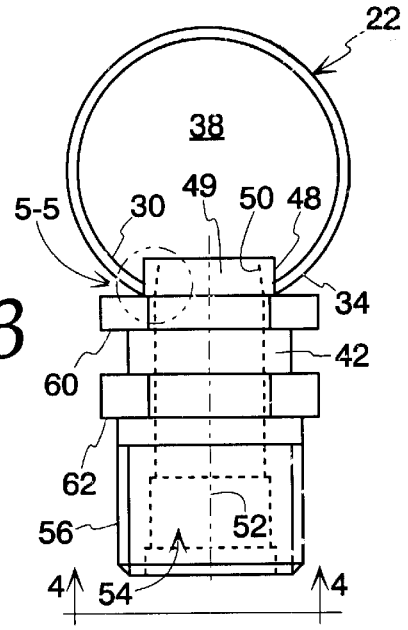
FIG. 3 is a section view taken along 2—2 in FIG. 1.

The fitting 24 includes a body 42 and a nipple 44 having a nominally cylindrical exterior surface 46 extending from the body 42. A portion 48 of the nipple 44 is extended from the body 42 by a distance D that is greater than the thickness t of the wall. The end of the nipple 44 includes a nominally circular port or opening 49. The cylindrical exterior surface 46 nominally conforms to the circular shape of the aperture 32 to allow the nipple 44 to be freely inserted into the aperture 32 so that the portion 48 extends into the interior volume 38 of the manifold 22, as shown in FIG. 3. The nipple 44 includes a nominally frustoconical shaped interior surface 50 that converges as it extends away from the body 42 to the port 49. The cylindrical exterior surface 46, the port 49, and frustoconical shaped interior surface 50 are nominally centered on an axis 52. The body 42 includes a nominally cylindrical shaped opening 54 that extends through the body 42 to allow access to the interior surface 50. The opening 54 is nominally centered on the axis 52.

In the embodiment shown in FIGS. 2 and 3, the body 42 further includes an exterior thread 56 that allows a tube or conduit (not shown) to be connected with a port 58 formed in the opening 54. A pair of hexagonal shaped shoulders 60 and 62 are provided adjacent the nipple 44 and the thread 56, respectively. The shoulders 60 and 62 can be engaged by a tool, such as a wrench, (not shown) to react torque when a connector is tightened onto the thread 56. The thread 56 and shoulders 60 and 62 are nominally centered on the axis 52.

A substantially cylindrical shaped staking tool 64 is provided for connecting the fitting 24 to the header 22. The tool 64 includes a nominally frustoconical shaped end 66 that is backed by a nominally cylindrical land 68 and a relief 70.

Figure 5:
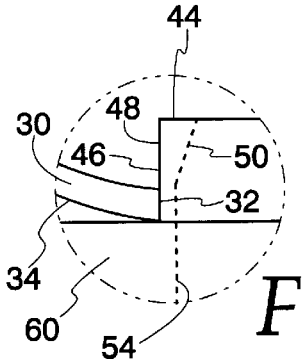
FIG. 5 is an enlarged view of the area indicated by line 5—5 in FIG. 3 showing a fitting in a first state.
Figure 6:
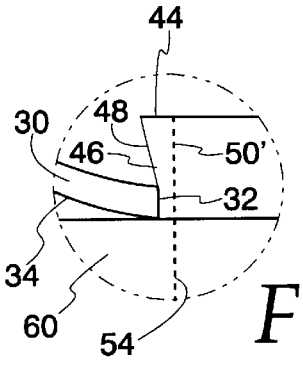
FIG. 6 is view similar to FIG. 5 showing the fitting in a second state.

To connect the fitting 24 to the manifold 22, the nipple 44 is inserted into the aperture 32 so that the portion 48 extends through the wall 30 into the interior volume 38 of the manifold 22 as shown in FIG. 3. The staking tool 64 is then inserted through the opening 54 in the direction of arrow A along the axis 52 so that the frustoconical end 66 engages the frustoconical interior surface 50. The staking tool 64 is then forced in the direction of arrow A along the axis 52 to deform the interior surface 50 through progressive engagement of the conical end 66 and the cylindrical land 68 with the surface 50. This operation results in the frustoconical interior surface 50 shown in FIG. 5 being permanently deformed into a nominally cylindrical surface 50' as shown in FIG. 6. The deformation of the interior surface 50 also permanently deforms the exterior surface 46 so that it flares out into a nominally frustoconical shape, as shown in FIG. 6. The resulting enlargement of the portion 48 restricts retraction of the nipple 44 from the aperture 32 because the portion 48 is larger than the aperture 32.

As best seen in FIG. 6, it may be desirable in some applications for the aperture 32, the exterior surface 46, the interior surface 50, the conical end 66 and the land 68 to be sized relative to each other so that, after the end portion 48 is deformed by the staking tool 64, the exterior surface 46 has a tight or interference fit against the periphery of the aperture 32 and the wall 30 is trapped between the shoulder 60 and the surface 48.

After the fitting 24 is positioned relative to the manifold 22 by deformation of the end portion 48 with the tool 64, the fitting 24 can be bonded to the manifold 22 to form a sealed joint between the nipple 44 and the aperture 32 using a suitable bonding technique, such as a suitable brazing process.

Figure 4:
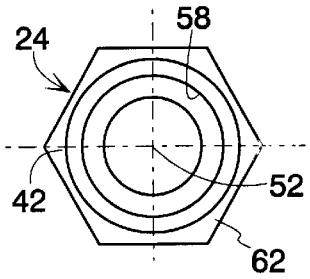
FIG. 4 is a view taken from line 4—4 in FIG. 3.
Figure 9:
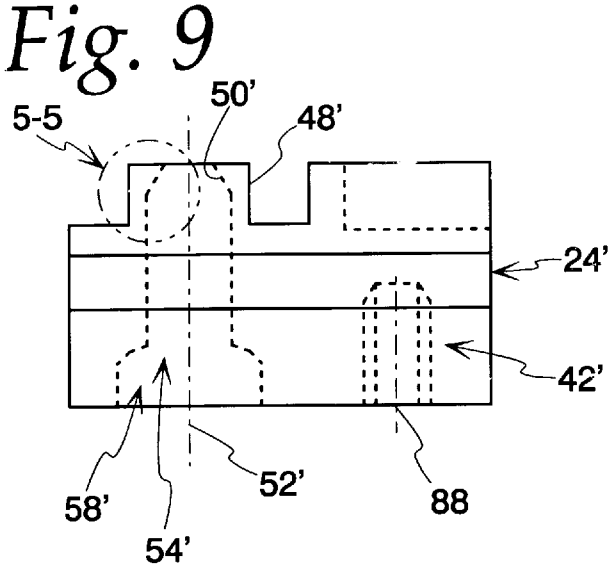
FIG. 9 is a side elevation of the fitting in FIG. 5.
Figure 10:
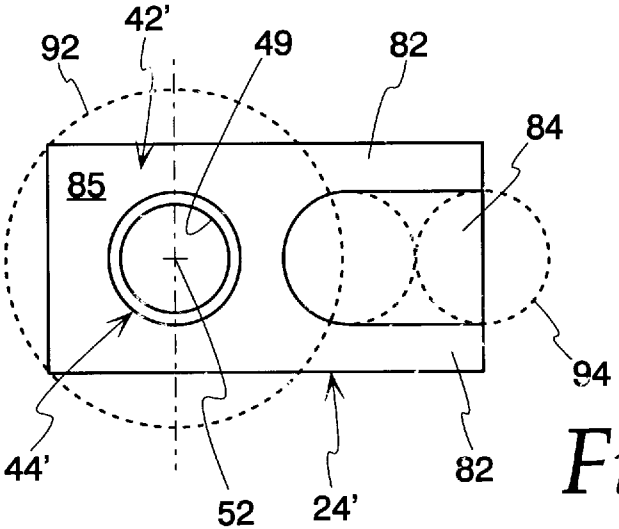
FIG. 10 is a top view of the fitting in FIG. 5.

Another embodiment of the fitting 24 is shown in FIGS. 7–10 and is identified as 24'. The nipple 44' of this embodiment is identical to the nipple 44 of the embodiment shown in FIG. 1, including the port 49, the portion 48, and the interior and exterior surfaces 46 and 50. However, the body 42' of the embodiment shown in FIG. 4 is different than the body 42 shown in FIG. 1. More specifically, the body 42' has a generally rectangular box shape with a saddle shaped portion 80 having a pair of surfaces 82 that nominally conform to the exterior shape of the wall 30, as shown by the phantom lines in FIG. 8. The surfaces 82 are spaced by a channel 84. A nominally flat surface 85 is provided at the intersection between the body 42' and the nipple 44'. As best seen in FIG. 9, a nominally flat surface 86 is provided on the side of the body 42' opposite from the nipple 44' and the saddle 80. A threaded hole 88 is provided in the surface 86 for engagement with a fastener (not shown) of a connector (not shown) that connects a tube or conduit with the nominally cylindrical port 58' formed in the nominally cylindrical opening 54'.

Figure 11:
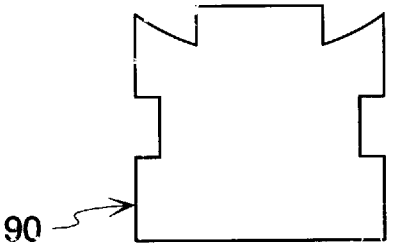
FIG. 11 is a view similar to FIG. 8 illustrating the shape of an extrusion that can be used to manufacture the fitting shown in FIG. 7.

While the embodiment of the fitting 24' shown in FIGS. 7–10 can be formed by any suitable manufacturing method, such as by casting, injection molding, metal injection molding, or machining, it is preferred that the fitting 24' be machined from an extrusion having the extruded shape 90 shown in FIG. 11. The nipple 44' and the channel 84 can then be machined using a circular cutter and an end mill cutting tool as shown by the phantom lines 92 and 94 in FIG. 10.

The fitting 24' is connected to the manifold 22 using the tool 64 and the method described above in connection with the fitting 24. As with the fitting 24, after the fitting 24' is positioned relative to the manifold 22 by deformation of the portion 48' with the tool 64, the fitting 24' can be bonded to the manifold 22 to form a sealed joint between the nipple 44' and the aperture 32 using a suitable bonding technique, such as a suitable brazing process. Additionally, the surfaces 82 of the saddle 80 are bonded to the surface 34 of the manifold 22 using a suitable bonding technique, such as a suitable brazing process. It may be preferred in some applications for the bonding of the surfaces 82 and 34 and the bonding of the nipple 44 and the aperture 32 to occur at substantially the same time using the same bonding technique.

FIG. 12 is a prospective view of yet another embodiment of the fitting 24. This embodiment is identified as 24" and is identical to the embodiment 24' shown in FIGS. 5–8, except for two modifications to the nipple 44 and one modification to the body 42. More specifically, as best seen in FIG. 13, the nipple 44" of the fitting 24" is provided with a closed end 98, rather than the port 49' shown in FIGS. 7–10. Additionally, as best seen in FIG. 13, the interior surface 50" is nominally cylindrical in its undeformed state, rather then frustoconical shaped surface 50' shown in FIGS. 7–10. Finally, a cylindrical opening 100 is provided through an end surface 102 of the body 42" and connects to the opening 54. The opening 100 is adapted to receive a jumper tube (not shown) that can be bonded in the opening 100 using any suitable process, such as a suitable brazing process to form a sealed joint. As shown in FIGS. 14 and 15, a staking tool 104 is provided to permanently deform the end portion 48". Specifically, the staking tool 104 includes four punches 106 that are mounted in the staking tool for radially outward movement in a direction nominally perpendicular to the axis 52". After the nipple 44" is inserted into the aperture 32, the staking tool 104 is inserted into the opening 54" and the four punches 106 are forced radially outward to permanently deform the interior surface 50" into the shape shown in FIG. 16. The punches 106 are then retracted radially inwardly and the staking tool 104 removed from the opening 54". The staking tool 104 is preferred for the fitting 24" because the closed end 98 of the nipple 44 " would prevent movement of the end 66 of the tool 64 past the surface 50". The fitting 24" can then be bonded to the manifold using the same method as described above for the fitting 22'.

While it is preferred that the fitting 24 and the manifold 22 be formed from aluminum, any suitable, permanently deformable material can be used for the fitting 24 and any suitable material can be used for the manifold 22 for all of the embodiments of the fitting 24 shown in FIGS. 1–16, as dictated by the requirements of each particular application. Further, while it is preferred that the aperture 32 be circular and the nipple 44 have a cylindrical exterior surface 46, it may be advantageous in some applications for other shapes to be used for these features. Additionally, while it is preferred that the aperture 32 and the surface 46 have nominally conforming shapes, it may be advantageous in some applications for at least portions of the aperture 32 and the surface 46 to be nonconforming to each other.

For all of the embodiments of the fitting 24 shown in FIG. 1–16, it should be appreciated that, by deforming the interior surface 50 with a deforming tool 64, 104 inserted through the body 42 of the fitting 24 on one side of the manifold 22, the fitting 24 can be connected to a manifold 22 without accessing the fitting 24 from the opposite side of the manifold 22.

What is claimed is:

1. A method of positioning a fitting relative to a manifold of a hear exchanger, the method comprising the steps of:

providing a manifold including a wall having an aperture therethough;

providing a fitting including a body, a nipple extending from the body and having an interior surface and an opening extending through the body to allow access to the interior surface;

inserting the nipple into the aperture from one side of the wall so that the body of the fitting is on one side of the wall and a portion of the nipple is on the other side of the wall;

deforming the interior surface of the nipple with a deforming tool inserted through said opening in said body when the nipple is on the other side of the wall to enlarge said portion to a shape that restricts retraction of said nipple from said aperture; and brazing the fitting to the manifold.

2. The method of claim 1 wherein said opening has a central axis and said deforming step comprises forcing said tool along said axis.

3. The method of claim 1 wherein said interior surface is a nominally frustoconical surface and said deforming step comprises deforming said frustoconical surface into a nominally cylindrical surface.

4. The method of claim 1 wherein said deforming step comprises enlarging said nipple to create an interference fit between said nipple and said aperture.

5. A fitting/manifold assembly for a heat exchanger, the assembly comprising:

a manifold including a wall, the wall having a thickness and an aperture aperture extending through the thickness from an exterior of the manifold to an interior of the manifold, the aperture having a predetermined shape;

a fitting including a body and a deformable nipple extending from the body, the nipple having an exterior surface, an interior surface, and a portion extended from the body a distance greater than said thickness of said wall, the nipple being deformable from a first shape to a second shape in the first shape the exterior surface of the nipple nominally conforms to the predetermined shape of the aperture to allow the nipple to be freely inserted into the aperture with the portion extending through the wall into the interior of the manifold, in the second shape said portion is enlarged to retain the nipple in the aperture, the fitting further including an opening extending through the body to allow access to the interior surface of the nipple by a deforming tool inserted through the opening to deform the nipple from the first shape to the second shape; and a brazed bond to form a sealed joint between the nipple and the aperture with the nipple deformed to the second shape.

6. The manifold assembly of claim 5 wherein the aperture is nominally circular and the exterior surface of the nipple is nominally cylindrical.

7. The manifold assembly of claim 5 wherein the interior surface of the nipple has a nominally frustoconical shape.

8. The manifold assembly of claim 5 wherein the nipple includes an open end.

9. A fitting/manifold assembly for a heat exchanger, the assembly comprising:

a manifold including a wall, the wall having a thickness and an aperture extending through the thickness from an exterior of the manifold to an interior of the manifold, the aperture having a predetermined shape; and a fitting including a body and a deformable nipple extending from the body, the nipple having an exterior surface, an interior surface, and a portion extended from the body a distance greater than said thickness of said wall, the nipple being deformable from a first shape to a second shape, in the first shape the exterior surface of the nipple nominally conforms to the predetermined shape of the aperture to allow the nipple to be freely inserted into the aperture with the portion extending through the wall into the interior of the manifold, in the second shape said portion is enlarged to retain the nipple in the aperture, the fitting further including an opening extending through the body to allow access to the interior surface of the nipple by a deforming tool inserted through the opening to deform the nipple from the first shape to the second shape;

wherein the nipple includes a closed end.

* * * * *